United States Patent [19]

Rawls et al.

[11] 3,955,840

[45] May 11, 1976

[54] DOOR RELEASE MECHANISM

[75] Inventors: William W. Rawls; Alex Buchholz, both of Mountaintop; John P. Walsh, Edwardsville, all of Pa.

[73] Assignee: Cornell Iron Works, Inc., Wilkes-Barre, Pa.

[22] Filed: Aug. 30, 1974

[21] Appl. No.: 502,016

[52] U.S. Cl. ..... 292/229; 292/201

[51] Int. Cl.[2] ..... E05C 3/12

[58] Field of Search ..... 292/201, 144, 336.3, 292/264; 49/1, 2, 379

[56] References Cited

UNITED STATES PATENTS

| | | | |
|---|---|---|---|
| 1,057,608 | 4/1913 | Wurmb et al. | 292/201 |
| 1,312,895 | 8/1919 | Derby | 292/201 |
| 1,417,430 | 5/1922 | Tulloch et al. | 292/201 |
| 1,702,621 | 2/1929 | Stelljes | 292/DIG. 48 |
| 3,386,761 | 6/1968 | Johnstone et al. | 292/201 |

*Primary Examiner*—Richard E. Moore

*Attorney, Agent, or Firm*—Emory L. Groff, Jr.

[57] ABSTRACT

A release mechanism for doors includes a pair of pivotally mounted cams one of which is displaceable to engage and retain a tensioned door sash element while the other cam locks and holds the first cam in said engagement until influenced by either the absence or presence of electrical power to a solenoid connected to the second one of said cams to cause displacement of the second cam and thus permit displacement of the first cam and release of the tensioned door sash element.

7 Claims, 5 Drawing Figures

DOOR RELEASE MECHANISM

This invention relates generally to a release mechanism for doors and more particularly to an improved device for initiating the closing of a door in response to the change in or signal from a specific electrical condition.

The release mechanism of the present invention is particularly adapted for controlling the operation of automatic closing mechanism associated with overhead doors such as rolling steel fire doors or store front security doors, yet from the description which follows hereinafter it will be readily appreciated that the subject mechanism is likewise applicable for controlling the operation of other types of closures such as sliding, swinging or non-rolling doors.

The release mechanism of the subject invention will be understood to serve as a control device to maintain a door or closure in an open condition by means of mechanical linkage therewith, which linkage is retained or locked and intended to be released responsive to the condition of an electrical circuit serving the instant mechanism.

In the case of fire doors, automatic closing thereof has been accomplished in either one of two ways. The simplest method of initiating the automatic closing of a fire door has been to incorporate a fusible link in series with a chain connected to the closing mechanism of the door, which link is designed to melt at a pre-determined temperature, for example 135°, thereby allowing the released chain to activate the closing mechanism which was therebefore retaining the fire door in the open position.

The other method which has been used in the past includes an electro-mechanical arrangement for releasing the door chain upon receiving a signal from a fire detecting device or a fire alarm system. The present invention falls into this second category and provides alternative construction wherein similar components may be arranged to provide either a normally energized system or a normally deenergized system. A normally energized release mechanism is one which may be considered to be of the fail-safe type in that it requires electrical power to maintain the door in the open position and will release the door not only upon receiving a signal from suitable fire detecting devices but also releases the door in the event of power failures. Such an arrangement is necessary in the case of doors which have no other means of initiating automatic closing since a power failure often precedes a fire. The alternate normally deenergized release mechanism requires electrical current to release the door and therefore is not considered fail-safe since it will not operate during a power failure and when this type of mechanism is utilized some form of auxiliary method of closing the door should also be used, such as the well known fusible links.

Accordingly, one of the primary objects of the present invention is to provide an improved door release mechanism including pivotal elements adapted to retain a door sash and which are displaceable from a locked to an unlocked position by means of an electrical element alternatively responsive to either the absence or presence of an electrical current to cause displacement of the pivotal elements and subsequent release of the door sash.

Another object of the present invention is to provide an improved door release mechanism for retaining a door sash having a fusible link therein and including a holding cam for engaging the door sash and which is retained in a locked position by means of a release cam, the actuation of which is controlled by a solenoid.

Still another object of the present invention is to provide an improved door release mechanism including a pair of pivotal cam elements for retaining a door sash and spring means constantly urging one of the cam elements toward a release position against the action of a solenoid.

With these and other objects in view which will more readily appear as the nature of the invention is better understood, the invention consists in the novel construction, combination and arrangement of parts hereinafter more fully described, illustrated and claimed.

Preferred and practical embodiments of the invention are shown in the accompanying drawings, in which.

Similar reference characters designate corresponding parts throughout the several figures of the drawings.

Figure 1:
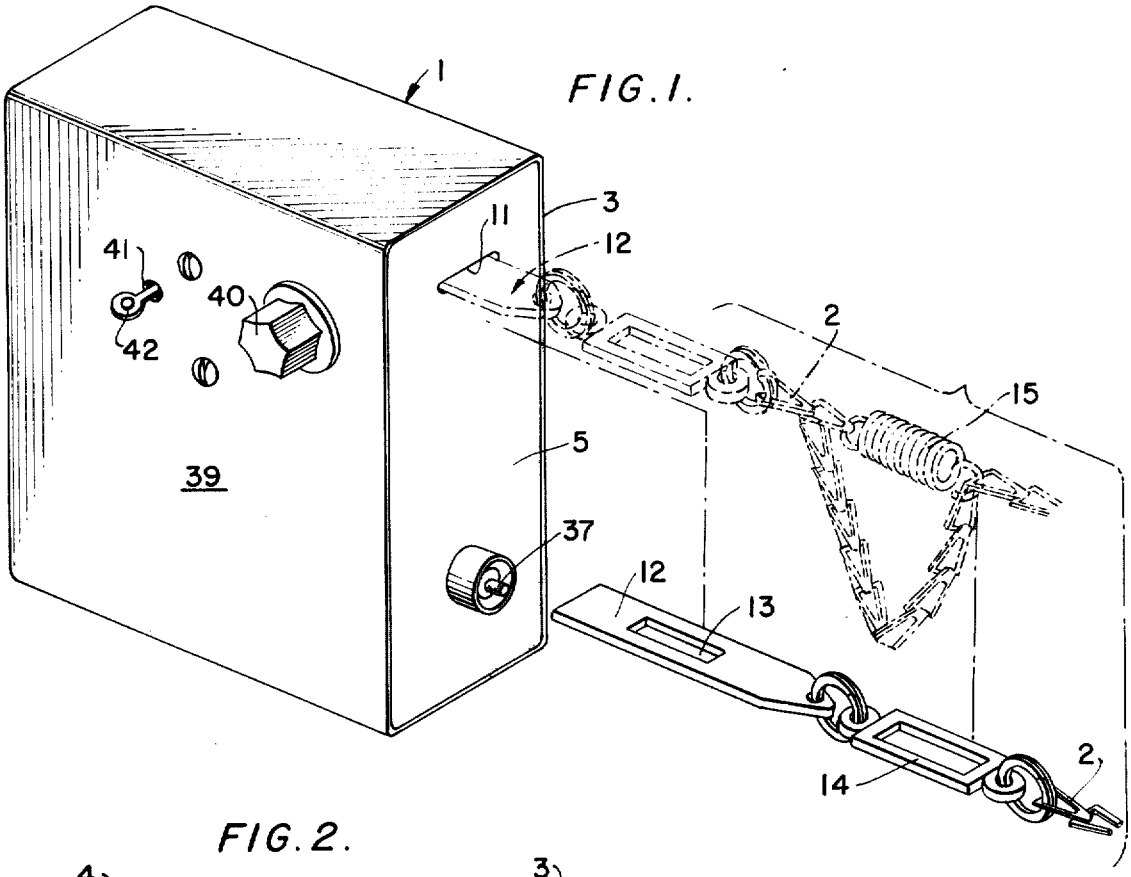
FIG. 1 is a perspective view of a door release mechanism according to the present invention.

Referring now to the drawings, particularly FIG. 1, the present invention will be seen to include a housing or control box generally designated 1, adapted to be mounted in a stationary position adjacent a doorway (not shown), usually near the top thereof, and intended to cooperate with a sash element such as the chain 2 having its other end (not shown) connected under tension to any suitable automatic door closing structure such as is well known to those versed in the art of rolling fire or security doors.

The control box 1 includes a back plate 3 through which suitable fastener elements 4—4 may be passed to secure the box 1 to a stationary support. From one vertical edge of the back plate 3 extends an inner side wall 5 while an outer side wall 6 extends from the opposite edge thereof so that the two side walls 5 and 6 combine to define a cavity 7 therebetween within which is disposed the operating mechanism of the control box. A small portion of the cavity 7 is further divided into a cam mechanism chamber 8 by means of a mounting plate 9 disposed in a parallel spaced-apart manner relative the underlying back plate 3 by means of a pair of spacer shafts 10—10. It will be understood that the inner side wall 5 is positioned in a manner to face the sash element 2 and is provided with a slot 11 therethrough, the dimensions of which are sufficient to provide a close sliding fit for sash holding means in the form of a chain end link 12, which link is provided with an elongated slot 13 as shown most clearly in FIG. 1 of the drawings. The link 12 is connected to the sash chain 2 by means of a fusible link 14 disposed in series therewith as is well known to those skilled in the art and additionally, suitable shock absorbing means such as the sash spring 15 may be incorporated in the sash chain 2 as shown in FIG. 1 for purposes which will become obvious hereinafter.

Figure 2:
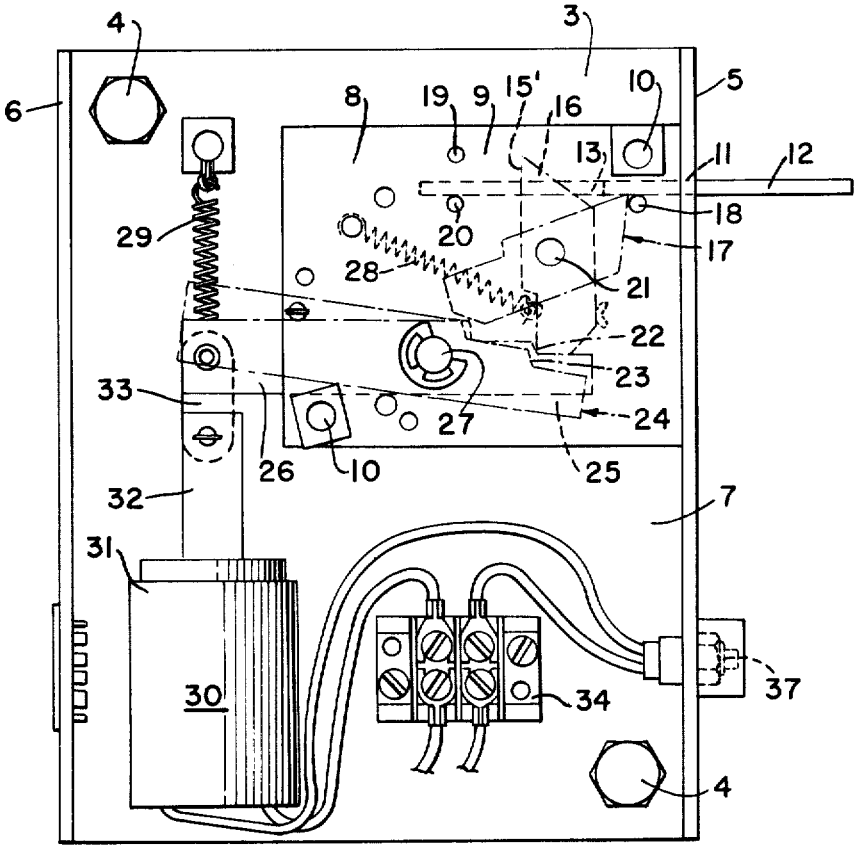
FIG. 2 is a front view, partly in section, of the interior of the mechanism of FIG. 1.

It will be understood that when the chain end link 12 is retained in proximity to the control box 1, the automatic door closing mechanism controlled by the sash chain 2 is held in engagement and the very purpose of the door release mechanism of the present invention is to provide automatic means for releasing the chain end link 12 from the control box 1 to thereby disengage the automatic door release mechanism to allow closing of the door associated therewith. In this respect novel means are provided within the control box to retain the end link 12 in the position as shown in FIG. 2 of the drawings wherein it will be seen that the link 12 has been inserted through the slot 11 and is secured in this position by means of a lock surface 15' adjacent the tongue 16 of a holding cam 17 which is disposed through the elongated slot 13 of the link 12. As long as positive mechanical means are employed to retain the holding cam 17 with its tongue 16 vertically disposed as shown in FIG. 2 it will be apparent that it is impossible for the chain end link 12 to be released by the mechanism contained within the control box 1.

The sash element 2 when disposed as shown in broken lines in FIG. 1 is in the locked or ready condition and will be understood to be under constant tension between the end attached to the automatic door closing mechanism and the end link 12 retained by the holding cam 17 and maintenance of this tension is assured by the proper attachment of the sash spring 15. Means are provided within the confines of the cam mechanism chamber 8 to facilitate insertion of the end link 12 therein and to preclude external release of this link without displacement of the holding cam 17 from its vertically oriented position. This means comprises a forward guide 18 and a vertically spaced apart rear top guide 19 and rear bottom guide 20, and it will be observed that with the upper and lower surfaces of slot 11 serving as a fulcrum the rear top guide 19 absolutely prevents the end link 12 from being withdrawn from the control box 1 when the tongue 16 is vertically disposed through the elongated slot 13 of the link. The holding cam 17 is substantially medially mounted for pivotal displacement by means of a holding cam and control knob shaft 21 and the lowermost portion of the holding cam is provided with a foot 22 facing the direction of the outer side wall 6. The purpose of this foot 22 will be quite apparent upon a review of FIG. 2 of the drawings wherein it will be seen that when the tongue 16 of the holding cam is vertically disposed this foot 22 is adapted to be engaged by a shoulder 23 formed on the release cam 24, which release cam includes a head 25 located beneath the holding cam 17 and at the opposite end a foot 26 extending laterally from the confines of the cam mechanism chamber 8.

The release cam 24 is likewise mounted for pivotal movement by means of the pivot shaft 27 and when its foot 26 is in the elevated or clockwise position the head 25 and its adjacent shoulder 23 will be seen to be depressed thereby releasing a foot 22 of the holding cam 17 to allow its clockwise pivotal displacement, which displacement is normally encouraged by means of the holding cam spring 28. At the same time it will be seen that the release cam 24 is normally urged in a clockwise direction about the pivot shaft 27 by means of the release cam spring 29 acting upon the foot 26 thereof and accordingly it will be apparent that in order to retain the release cam 24 in a counter-clockwise direction with its shoulder 23 engaging the foot 22 of the holding cam to maintain a chain end link 12 in the locked position within the control box, it will be necessary to apply some form of outside force to the foot 26 of the release cam 24 in a downward direction.

The reference outside force is provided by means of an electrical element comprising the solenoid 30 having a conventional coil 31 mounted in a stationary manner and from which extends an axially displaceable actuating arm 32. A connecting link 33 has one end pivotally attached to the foot 26 of the release cam 24 and its opposite end pivotally attached adjacent the distal portion of the solenoid actuating arm 32 so that subsequent linear displacement of the actuating arm 32 may be translated as an arcuate displacement of the release cam 26 without any undue lateral stress upon the solenoid mechanism.

Figure 3:
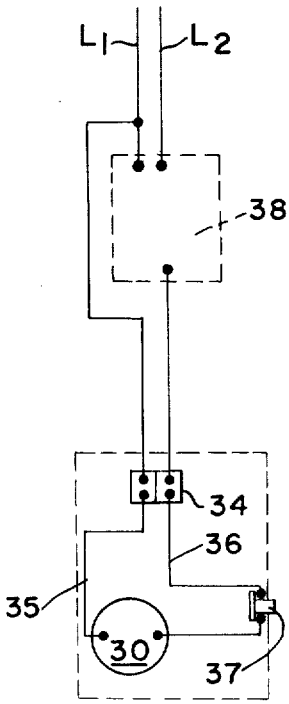
FIG. 3 is a diagrammatic illustration of an electrical circuit associated with the mechanism of FIGS. 1 and 2.

As previously described, the embodiment illustrated in FIGS. 1–3 relies upon a normally energized electrical environment. In other words, in order to retain the chain end link 12 securely locked within the control box 1 by means of the tongue 16 of the holding cam 17 it will be obvious that this holding cam must be locked into its vertical position by means of the release cam 24 which must be positively urged in a counter-clockwise direction against the omnipresent force of the release cam spring 29. It therefor follows that a constant downward force must be applied to the foot 26 of the release cam by means of the solenoid actuating arm 32 which means that an electrical current must at all times be supplied to the coil 31 of the solenoid 30 to override the force of the release cam spring.

A typical wiring diagram suitable for accomplishing the desired result specified above is shown in FIG. 3 of the drawings and includes a pair of power leads $L_1$, $L_2$, leading to a terminal strip 34 within the control box 1. From the terminal strip another line 35 supplies the solenoid directly while a second line 36, which also supplies the solenoid, includes in series a normally closed test button switch 37. If the lead $L_1$ and $L_2$ are continuous from a source of power to the control box 1 it will be apparent that the solenoid 30 will at all times be activated to cause retraction of its actuating arm 32 and a downward displacement of the release cam foot 26, in which case only a power failure will cause the actuating arm 32 to yield to the force of the release cam spring 29 resulting in release of the chain end link 12 from the door release mechanism. Of course, at any time when it may be necessary to test the operation of the door release mechanism one need only depress the test button switch 37 to interrupt the current passing through the line 36 which would likewise cause de-activation of the solenoid 30 and release of the chain end link 12. Most often it is desirable to provide a suitable fire or smoke detection apparatus or additional signal device in the electrical circuitry serving the door release mechanism, in which case a suitable detection or signal device 38 is included in series with at least one of the power leads $L_2$ so that if an emergency occurs and the power system is still operative, the power supplying the control box 1 will be interrupted to initiate release of the chain end link 12 and sash element 2.

A U-shaped cover 39 is adapted to close off the cavity 7 and includes an aperture (not shown) through which one end of the holding cam and control knob shaft 21 extends to provide mounting means for a holding cam control knob 40. This control knob and/or the face of the cover 39 may be provided with suitable indicia to visually indicate the relative condition or position of the holding cam 17 which is rigidly attached to the shaft 21 as is the control knob 40. The cover 39 is provided with an additional aperture 41 which is located at a position intermediate the release cam shaft 27 and foot 26 and at an elevation intended to correspond to the plane of the upper portion of the release cam 24 when in the locked or ready position. Thus it will follow that upon the insertion of a suitable holding pin 42 through the aperture 41 the shank of this pin will serve to retain the release cam 24 in the locked or ready condition should it be desired to de-activate the operation of the door release mechanism such as would be the case when the electrical power is to be intentionally turned off for a period of time and it is not desired to permit the door release mechanism to release the chain end link 12 and sash element 2.

Figure 4:
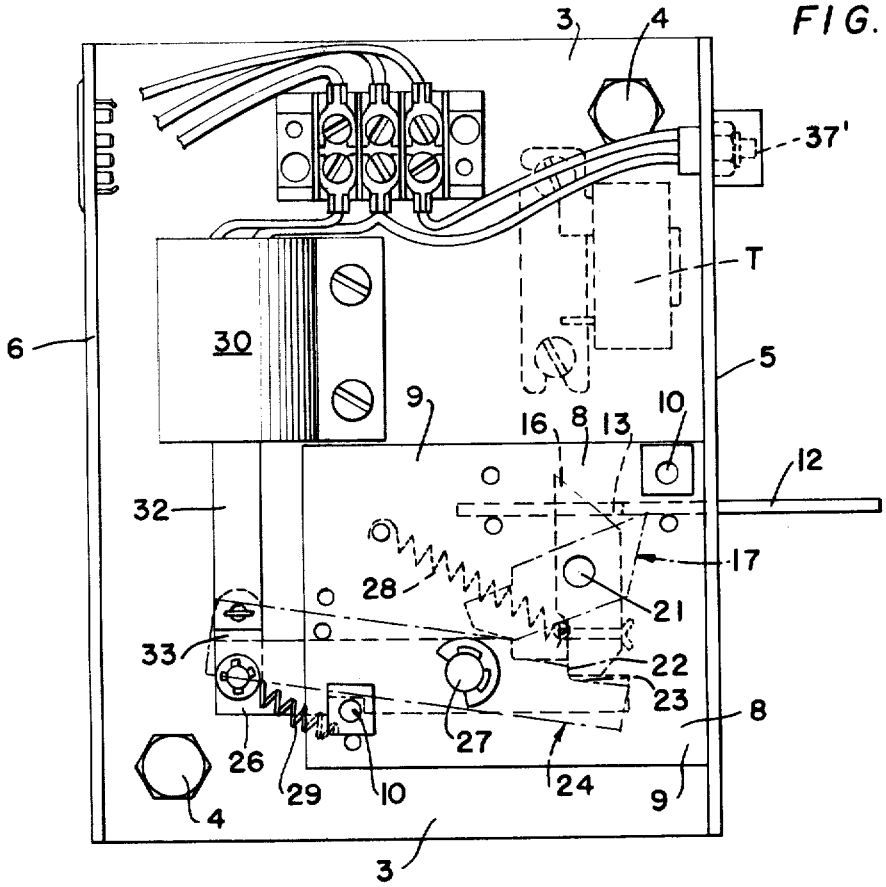
FIG. 4 is a view similar to FIG. 2 and illustrates a modification thereof.
Figure 5:
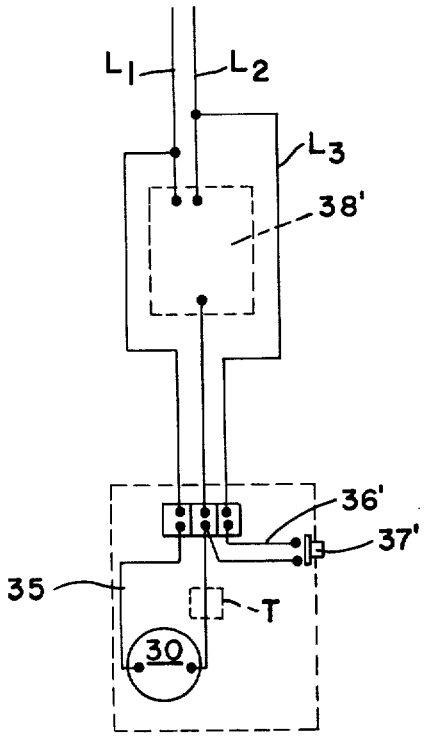
FIG. 5 is a digrammatic illustration of an electrical circuit associated with the embodiment of FIG. 4.

In the embodiment illustrated in FIGS. 4 and 5 a door release mechanism is disclosed which employs the same basic components as shown in the first described embodiment yet which are rearranged to accommodate a system wherein the electrical power is normally off, thereby requiring the presence of electrical power to release the chain end link 12. The very same mounting plate 9 and its attendant structure as is used in the first described embodiment is utilized in this modification, but will be seen to be positioned upon the back plate 3 in a manner to permit location of the solenoid 30 at a point above the mounting plate 9 so that when electrical current is supplied to the solenoid its actuating arm 32 will be drawn upwardly and by means of the connecting link 33 will cause clockwise pivotal displacement of the release cam 24 in an overriding manner against the force of the release cam spring 29, which in this instance normally retains the release cam in a counterclockwise direction so as to maintain its shoulder 23 in engagement with the foot 22 of the holding cam 17.

From a review of the circuit diagram of FIG. 5 of the drawings it will be observed that the same leads $L_1$ and lead $L_2$ are utilized to supply current to the door release mechanism of this embodiment. However, the fire detection device or signal apparatus 38' in this instance is of the type which holds the circuit open during normal conditions and closes the circuit upon the detection of fire or smoke or actuation of some other signal mechanism. A parallel lead $L_3$ bypasses the detection device 38' and is connected to a normally open test button switch 37' by means of the line 36' so that when the mechanism is intended to be tested, depression of the switch 37' completes the circuit to the solenoid 30 thereby causing actuation of the solenoid arm 32 and release of the chain end link 12. A suitable time delay device T may be incorporated in series with the line 36' to the solenoid to preclude undesirable actuation of the door release mechanism should there be a false short-term application of power to the illustrated circuitry.

We claim:

1. A door release mechanism comprising, a housing having an elongated slot therethrough, sash means including a distal elongated sash element having an elongated slot therethrough extending longitudinally of said sash element, said sash element disposed through said housing slot with said sash element slot within said housing, said housing slot dimensions providing a close sliding fit with the width and thickness of said sash element, means providing a constant pulling force on said sash element away from said housing slot, an elongated holding cam intermediately pivoted within said housing disposed normal to said sash element and having a tongue at one end disposed through said sash element slot and retaining a portion of said sash element within said housing against the effect of said pulling force means, said holding cam having a foot at its other end, an elongated release cam intermediately pivoted within said housing disposed normal to said holding cam and having a shoulder adjacent one end engaging said holding cam foot and precluding pivotal displacement of said holding cam from its position normal to said sash element, said release cam having a foot at its other end, a solenoid including a coil fixedly mounted within said housing with a central axis normal to said release cam foot, an elongated actuating arm extending from within said coil fixed for longitudinal reciprocating displacement in alignment with said coil central axis, pivotal means connecting the free end of said actuating arm to said release cam foot, spring means joined to said release cam foot adjacent said pivotal connecting means and applying a constant force to urge said release cam foot away from said coil actuating arm, and circuit means connected to said solenoid whereby operation of said circuit means reciprocates said actuating arm and displaces said release cam shoulder from engagement with said holding cam foot so that the pulling force on said sash element angularly displaces said holding cam to withdraw its tongue from said sash element slot as said sash element is withdrawn from said housing slot.

2. A release mechanism according to claim 1 wherein, said spring means normally biases said release cam shoulder into engagement with said holding cam foot.

3. A release mechanism according to claim 1 wherein, said spring means normally biases said release cam shoulder away from engagement with said holding cam foot.

4. A release mechanism according to claim 1 wherein, said circuit means normally supplies an energizing current to said solenoid to maintain engagement between said cams and said spring means biases said release cam away from its engagement with said holding cam but with a force less than that applied by said actuating arm when said energizing current is supplied.

5. A release mechanism according to claim 1 wherein, said circuit means normally is de-energized to said solenoid, and said spring means biases said release cam into engagement with said holding cam but with a force less than that applied by said actuating arm when said circuit means supplies energizing current to said solenoid.

6. A release mechanism according to claim 4 including, signal responsive means in said circuit means for opening said normally energized current to said solenoid.

7. A release mechanism according to claim 5 including, signal responsive means in said circuit means for energizing said normally de-energized circuit means to said solenoid.

* * * * *